US005933905A

United States Patent [19]

Hess

[11] Patent Number: 5,933,905

[45] Date of Patent: Aug. 10, 1999

[54] PAINT TRIMMING APPARATUS WITH GUIDE

[76] Inventor: Robert Hess, 804 Moore Dr., Chelsea, Mich. 48118

[21] Appl. No.: 08/968,390

[22] Filed: Nov. 12, 1997

[51] Int. Cl.[6] ..... A46B 15/00

[52] U.S. Cl. ..... 15/160; 15/166; 15/210.1; 118/264; 118/504

[58] Field of Search ..... 15/166, 160, 209.1, 15/210.1; 118/264, 504

[56] References Cited

U.S. PATENT DOCUMENTS

| | | |
|---|---|---|
| 2,810,148 | 10/1957 | Wood, Jr. . |
| 3,172,140 | 3/1965 | Burns et al. . |
| 3,714,675 | 2/1973 | Koptelow . |
| 3,722,019 | 3/1973 | Magnien . |
| 4,594,015 | 6/1986 | Pomares . |
| 5,134,745 | 8/1992 | Burns et al. . |
| 5,433,533 | 7/1995 | Magnien . |

*Primary Examiner*—Randall E. Chin
*Attorney, Agent, or Firm*—Dykema Gossett PLLC

[57] ABSTRACT

A paint trimming apparatus has a mounting plate of generally uniform thickness having a longitudinal axis, a top surface, a bottom surface, a front edge, a rear edge, and a pair of parallel side edges. A handle having a front end and a back end is mounted on the top surface of the mounting plate and extends along the longitudinal axis forwardly from the rear edge towards and spaced from the front edge. A generally elongated planar guide has a guide edge substantially parallel to the front edge. The guide edge has a length generally corresponding to the length of the front edge. A guide support is coupled to the mounting plate between the front end of the handle and the front edge of the mounting plate. The guide support pivotably couples the guide to the guide support to position the guide edge to overlie the front edge and position the guide between the loading position and paint trimming position. The guide support yieldably biases the guide to the loading position.

30 Claims, 5 Drawing Sheets

PAINT TRIMMING APPARATUS WITH GUIDE

BACKGROUND OF THE INVENTION

The present invention relates generally to a painting apparatus and, more particularly, to a paint applying device adapted to quickly and neatly paint edges between adjoining surfaces.

Painters commonly use brushes or rollers to paint large wall surfaces in an efficient manner. Using rollers or brushes, however, to form borders between two adjacent surfaces is extremely difficult at best. Several devices for forming borders have been suggested in the prior art.

One popular device has a replaceable pad that is coupled to a flat mounting plate. The mounting plate has a pair of rollers that extend beyond the mounting plate and pad. The rollers ride along the adjacent surface to provide a guide for the pad. For satisfactory operation of the device, the wheels must ride along the adjacent surface. If, however the adjacent surface is very thin or tapered, the wheels are likely to be offset far enough from the surface to be painted that the wheels will not engage the adjacent surface. Another disadvantage of such device is that once paint is picked up by the wheel edges, it is very difficult to sufficiently clean the device to prevent the spread of paint to the adjacent surface.

Another type of device also uses a flat pad having a fixed blade along one edge of the pad. During loading of the pad paint is unavoidably applied to the edge. Paint must then be wiped from the edge before applying paint to the adjacent surface. The result is that the paint operation becomes messy and wasteful.

In yet another known type of tool, an applicator pad is coupled to a mounting plate as in the above devices. A guide member is pivotably mounted to the base. A spacing member is coupled to the guide member and extends beyond the top edge of the mounting plate. When in the paint trimming position the spacing member is parallel to the surface adjacent to the surface to be painted. The spacing member in the trimming position does not extend to the surface to be painted.

Several drawbacks to such a device are apparent. Because the spacing member does not extend to the surface to be painted, and due to the fact that the bristles on the pad have a tendency to flex in an outward direction while applying pressure to the pad, a straight line is dependent upon the pressure of the pad due to the flexing of the bristles. That is, because the spacing member cannot control the amount of flex of the bristles on the pad, paint may be inadvertently applied to the surface adjacent the painted surface.

Another drawback to such a device is that paint may be easily transferred to the adjacent surface. Paint may wick between the spacing member and the adjacent surface. Because the spacing member is parallel to the surface adjacent the surface to be painted, paint tends to wick or to be drawn between the flat edge of the spacing member and the adjacent surface.

Yet another drawback to such a device is that because the guide member does not extend to the interface between the two adjacent surfaces, if the surface adjacent the outer surface is for example a very thin laminate type material, the spacing member may not extend far enough to contact the adjacent surface.

The prior art devices do not provide for a clean line along rough cast ceilings as does the present invention.

SUMMARY OF THE INVENTION

It is therefore an object of the invention to provide a paint trimming apparatus suitable for easy loading of paint while providing a reliable apparatus to form a neat and straight border between the two surfaces.

In one aspect, the present invention provides a paint trimming apparatus having a mounting plate of generally uniform thickness having a longitudinal axis, a top surface, a bottom surface, a front edge, a rear edge, and a pair of parallel side edges. A handle having a front end and a back end is mounted on the top surface of the mounting plate and extends along the longitudinal axis forwardly from the rear edge towards and spaced from the front edge. A generally elongated planar guide has a guide edge substantially parallel to the front edge. The guide edge has a length generally corresponding to the length of front edge. A guide support is coupled to the mounting plate between the front end of the handle and the front edge of the mounting plate. The guide support pivotably couples the guide to the guide support to position the guide edge to overlie the front edge and position the guide between the loading position and paint trimming position. The guide support yieldably biases the guide away from the paint trimming position.

In a further aspect, the present invention provides a guide support extending across the mounting plate from one of the side edges to the other of the side edges. The guide support is integrally molded with the mounting plate and guide.

In yet a further aspect, the present invention provides a guide support having a first member mounted to the mounting plate and a second member mounted to the guide. Preferably, a pair of first members and a pair of second members are provided. One pair of a first member and a second member are positioned near one of the parallel edges. The first member and second member are pivotably joined at a pivot pin extending therebetween. A biasing spring is preferably coupled to one of the first member, second member or mounting plate to bias the second member and thus the guide away from the pivot trimming position.

One feature of the present invention is the relative position and extent of the guide. The guide preferably extends at an angle with respect to the adjacent surface, assuming the adjacent surface is perpendicular to the pad. The guide edge of the guide is also preferably tapered and extends between the interface between the two surfaces. In such a manner, even if the surface adjacent the surface to be painted is relatively thin, the guide edge may contact the adjacent surface for guidance.

Another feature of the present invention is that the paint applicator will control "cutting in" and assures a sharp clean line along ceilings, rough cast ceilings, baseboards and other trim areas. "Cutting in" is the brushing technique that is used when a clean sharp edge is needed. Cutting in is needed, for example, for the top of a wall where it meets the ceiling and in areas that are hard to reach, especially when using a roller.

Still another feature is that with the present invention, the paint rarely gets on the outside of the guide but rather is found up and away along the inside of the blade. This provides a clean paint line.

BRIEF DESCRIPTION OF THE DRAWINGS

Other features and advantages of the present invention will become apparent in the following detailed description which should be read in conjunction with the drawings, in which.

DETAILED DESCRIPTION OF THE PREFERRED EMBODIMENT

Figure 1:
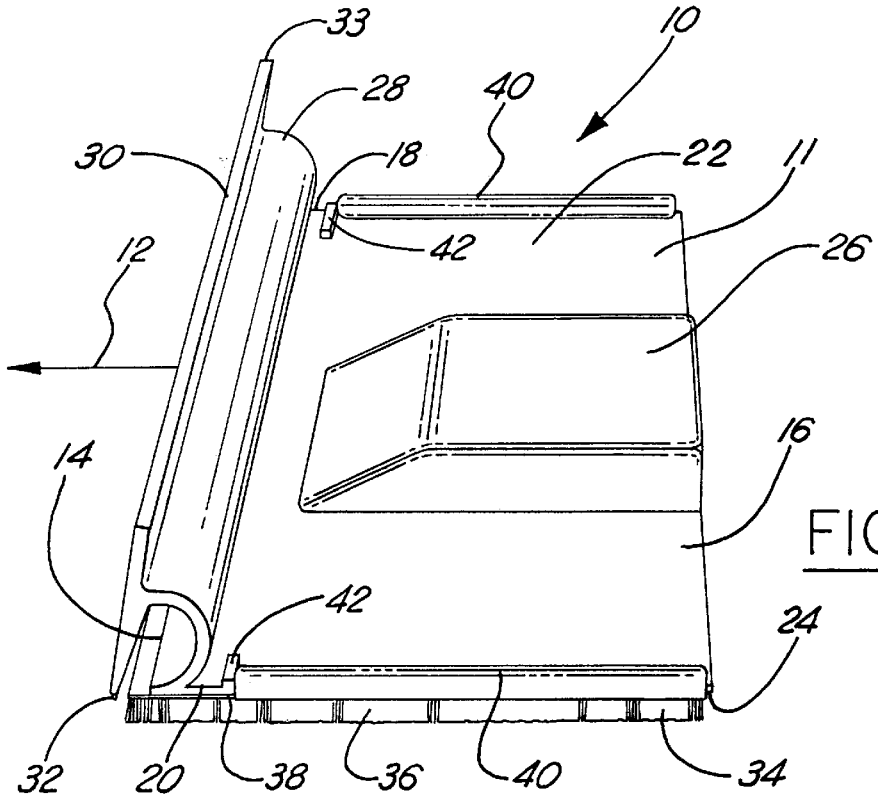
FIG. 1 is a perspective view of a first embodiment of a paint trimming apparatus in a paint trimming position.

In the following figures, like reference numerals will be used to represent like components. The figures illustrate various embodiments of a paint trimming apparatus formed of plastic material and having a slidably mounted paint pad. However, various types of paint pads and materials used to form the paint trimming apparatus would be evident to those skilled in the art.

Referring now to FIGS. 1 to 6, the paint trimming apparatus 10 has a mounting plate 11 preferably having a generally rectangular shape and of uniform thickness. Mounting plate 11 has a longitudinal axis 12, a front edge 14, a rear edge 16, a first side edge 18, a second side edge 20, a top surface 22 and a bottom surface 24. Mounting plate 11 is generally planar. Mounting plate 11 has a handle 26 coupled thereto. Preferably, handle 26 is integrally molded to top surface 22 of mounting plate 11. Handle 26 preferably extends along longitudinal axis 12 from rear edge 16 to a location short of front edge 14. Handle 26 is wide enough to allow comfortable gripping during painting operations. Handle 26 may be solid or hollow. Mounting plate 11 and handle 26 may be made from clear or colored plastic material such as polypropylene.

Paint trimming apparatus 10 also has a guide support 28 extending from mounting plate 11. As will be described further below, support 28 may be integrally molded with mounting plate 11 or may be a separate component mounted to mounting plate 11 during assembly. As shown in the first embodiment support 28 has a generally C-shape that extends between first side 18 and second side 20. As would be evident to one skilled in the art, however, support 28 may also be segmented along its length.

Support 28 couples mounting plate 11 to a guide 30. Guide 30 preferably also extends between first side 18 and second side 20. Support 28 is flexible to allow guide 30 to be easily placed in various positions with respect to front edge 14. Guide 30 preferably has a generally planar rectangular shape. A portion of guide 30 extends above support 28 while a second portion of the guide extends forward of front edge 14.

Guide 30 has a guide edge 32 on its lower end portion preferably positioned parallel to front edge 14. It is also preferred that the lower end portion of guide 30 tapers to a point or nearly to a point at guide edge 32. That is, the included angle 35 (of FIG. 4) of intersecting surfaces forming the tapered point preferably are in the range of 7° to 12°. In the preferred embodiment the angle between the intersecting surface is 9°.

Guide 30 has an upper end portion 33. Upper end portion 33 is used to position guide 30. Upper end portion 33 forms a lever about which guide 30 pivots.

A paint absorbent pad 34 is coupled to mounting plate 11. Paint absorbent pad 34 preferably has bristles 36 mounted to a backing 38. Pad 34 removably couples to mounting plate 11 in a conventional manner. That is, pad 34 may, for example, be one of several varieties of pads available on the market. Consequently, the size and shape of mounting plate 11 may conform to the conventional mounting pads. Pad 34 may be secured by adhesive, as illustrated, backing 38 extends beyond first side 18 and second side 20 to form mounting edges 40. Mounting edges 40 curl away from the bristle side of pad 34. To mount the removable pad on mounting plate 11, first side 18 and second side 20 are positioned between the curled mounting edges 40 and backing 38. Pad 34 is thus slid forward from rear edge 16 until mounting edges 40 contact stops 42. Mounting edges 40 preferably do not extend fully along the extent of the sides 18, 20 of pad 34, to prevent mounting edges 40 from interfering with support 28. Thus, stops 42 are positioned rearward of front edge 14. Stops 42 may, for example, be integrally molded with mounting plate 11. Preferably stops 42 are rectangular in shape and extend above the back surface of mounting plate 11.

Figure 2:
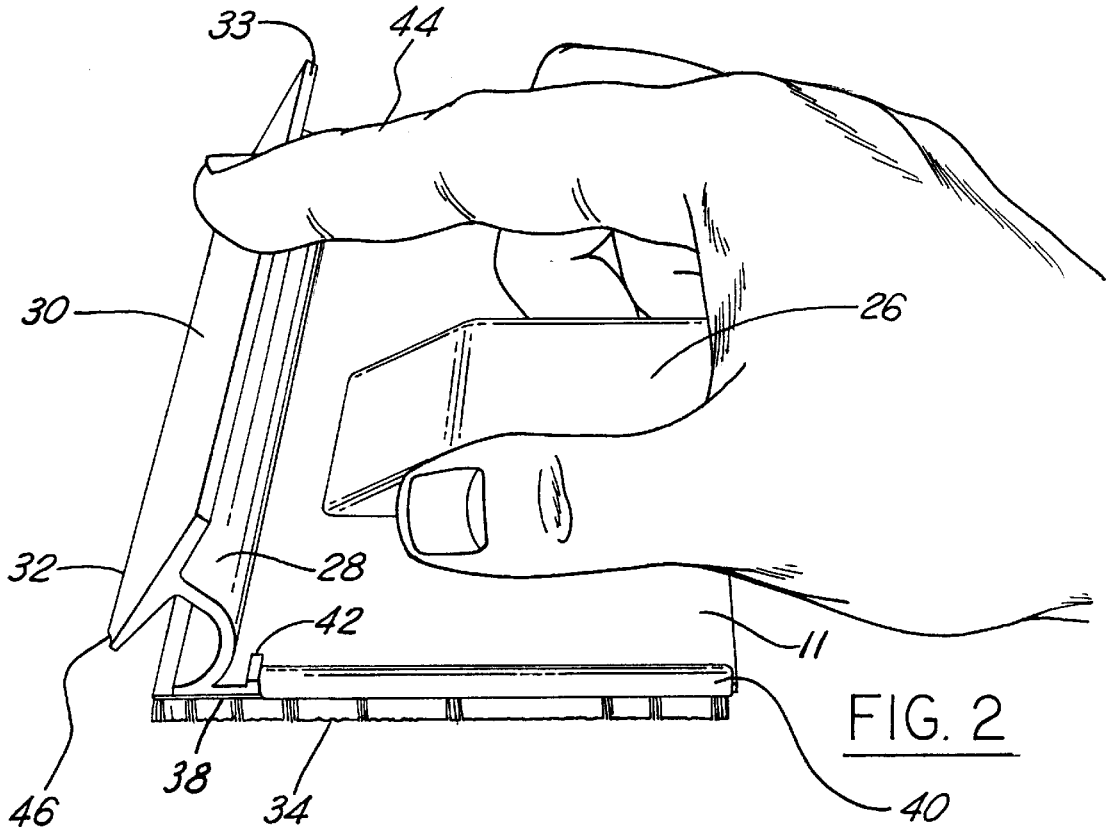
FIG. 2 is a perspective view of the first embodiment of the paint trimming apparatus in a loading position.
Figure 4:
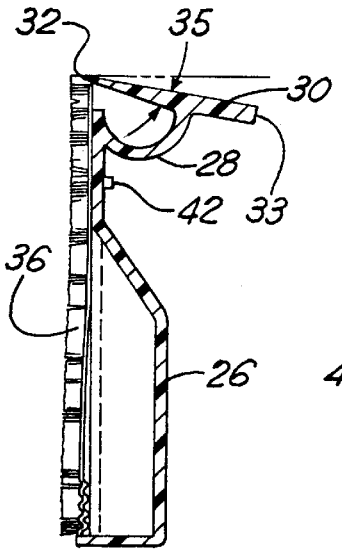
FIG. 4 is a cross-sectional view of the paint trimming apparatus of FIG. 3 along line 4—4.
Figure 3:
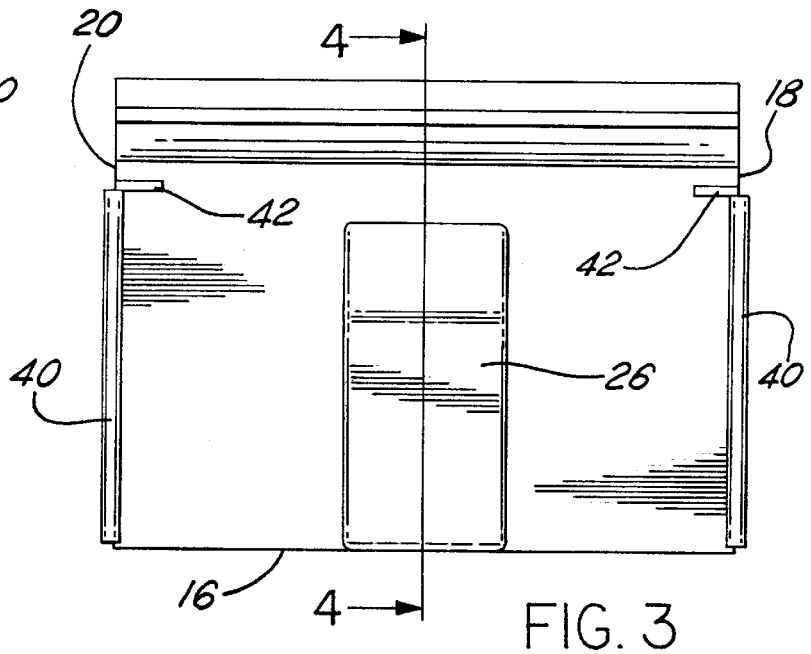
FIG. 3 is a top view of the paint trimming apparatus.
Figure 5:
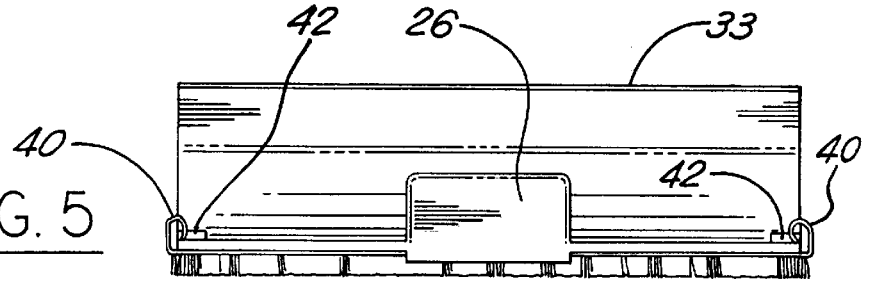
FIG. 5 is a rear view of the paint trimming apparatus.

Support 28 is flexible as described above. As shown in FIG. 2, guide 30 may easily be positioned by a index finger 44 while gripping handle 26 of an operator. Index finger 44 may pivot guide 30 about support 28 into a paint trimming and paint loading position.

Figure 6:
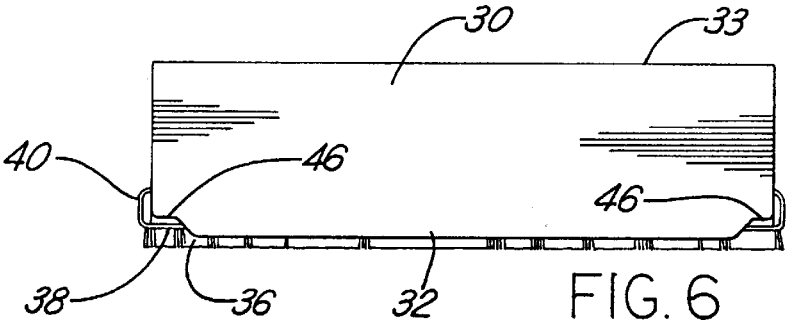
FIG. 6 is a front view of the paint trimming apparatus.

As best shown in FIG. 6, guide edge 32 of guide 30 preferably has a notched portion 46. Notched portion 46 does not extend the full width of guide 30.

Figure 7:
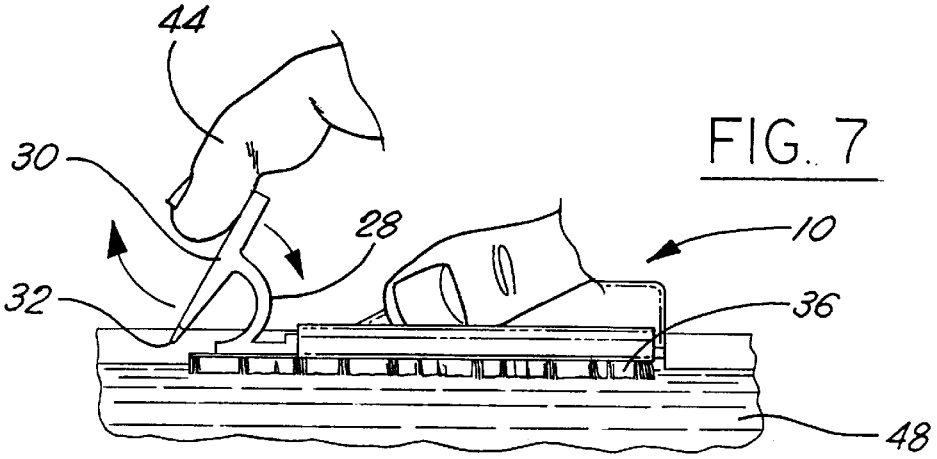
FIG. 7 is a side view of the paint trimming apparatus in a loading position.

Referring now to FIG. 7, paint trimming apparatus 10 is shown in a loading position. That is, index finger 44 provides a backward and downward force on the top of guide 30. Guide 30 pivots upon support 28 which flexes in a backward position. In the loading position guide edge 32 does not contact paint 48 in the paint holder. In the loading position, excess paint 48 may easily be removed so that paint is not applied to guide edge 32.

Figure 8:
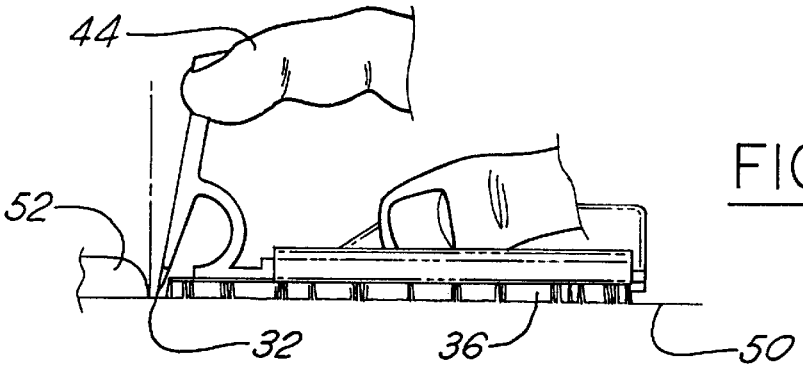
FIG. 8 is a side view of the paint trimming apparatus in a neutral position.

Referring now to FIG. 8, paint trimming apparatus 10 is positioned on a paintable surface 50. Guide 30 is in a neutral position. In the neutral position, no force is applied from index finger 44 to guide 30. Guide edge 32 is positioned above the edge of bristles 36.

Figure 9:
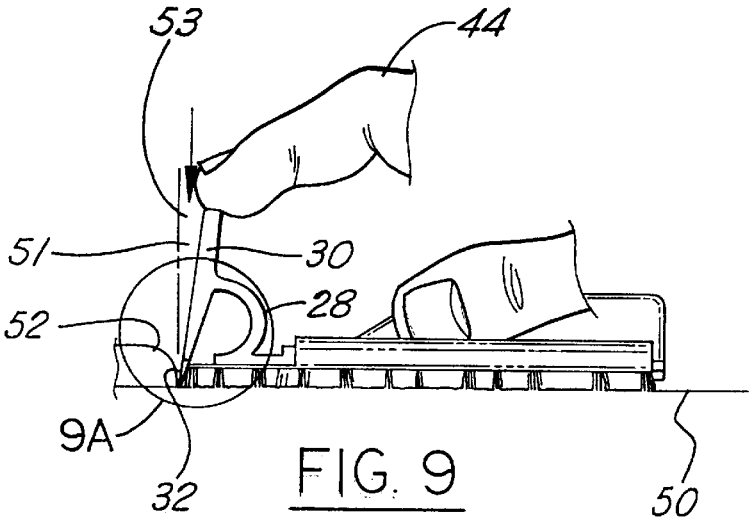
FIG. 9 is a side view of the paint trimming apparatus in a paint trimming position.
Figure 9A:
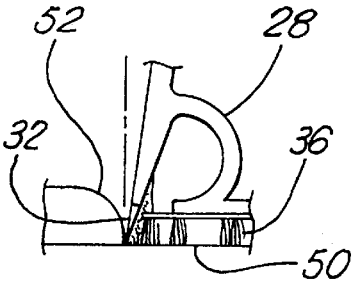
FIG. 9A is a side view of a portion of FIG. 9 showing a tapered guide edge at the interface between the surface to be painted and the adjacent surface.

Referring now to FIGS. 9 and 9A, index finger 44 is shown applying a downward force upon guide 30 so that guide edge 32 extends to the intersection of paintable surface 50 and adjacent surface 52. Support 28 is thus flexed forwardly. By allowing guide edge 32 to extend to the intersection of paintable surface 50 and adjacent surface 52, when a force is applied on pad 34 bristles 36 tend to flare in an outward direction. Guide edge 32 thus prevents bristles 36 from flaring outward and contacting adjacent surface 52.

An angle 53 is formed between guide 30 and a line 51 perpendicular to that of paintable surface 50. In such a manner, guide edge 32 is capable of contacting the intersection of paintable surface 50 and adjacent surface 52. In such a manner, it is the intersection between paintable surface 50 and adjacent surface 52 that provides the guide and not adjacent surface 52. It should be noted that the paint on the inside surface of the guide edge 32 is forced upwardly and away from the tip thereby allowing a clean paint line. This prevents the paint from traveling along the outside surface of the guide edge 32 thereby preventing a messy cleanup.

Figure 10A:
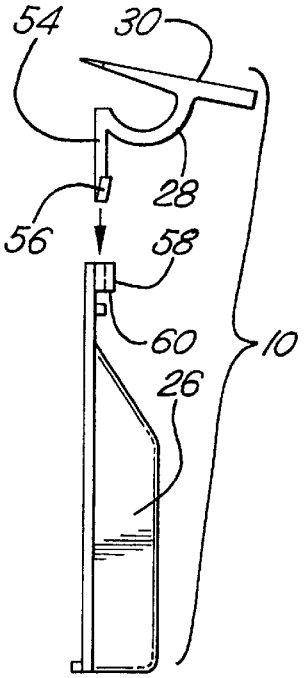
FIG. 10A is a side view of a second embodiment of a paint trimming apparatus having a separate guide support and guide edge.
Figure 10B:
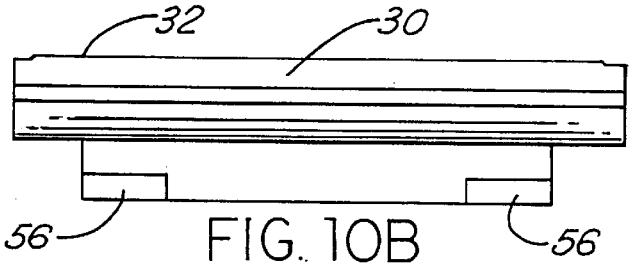
FIG. 10B is a top view of a guide edge and guide support of FIG. 10A.
Figure 10C:
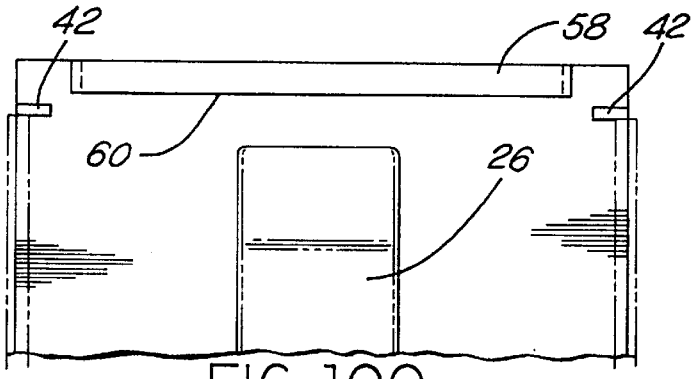
FIG. 10C is a top view of a mounting plate of FIG. 10A adapted to couple with the guide and guide support of FIG. 10B.

Referring now to FIGS. 10A, 10B and 10C second embodiment for the configuration of paint trimming apparatus 10 is shown. In this configuration support 28 and guide 30 are coupled to a mounting portion 54. Mounting portion 54 is generally parallel to mounting plate 11. Mounting portion 54 has a tab 56 that is used to engage a receiver 58 on mounting plate 11. Receiver 50 is generally a bridge-like structure extending above at least a portion of mounting plate 11. Mounting portion 54 is sized to be received into receiver 58. Tabs 56 deflect in a downward position upon insertion into receiver 58. As tabs pass through receiver 58, tabs 56 then flex upward to engage the back edge 60 of receiver 58. The configuration of FIGS. 10A through 10C thus may be easy to manufacture since support 28, guide 30 and mounting portion 54 are formed as a separate unit.

Figure 11A:
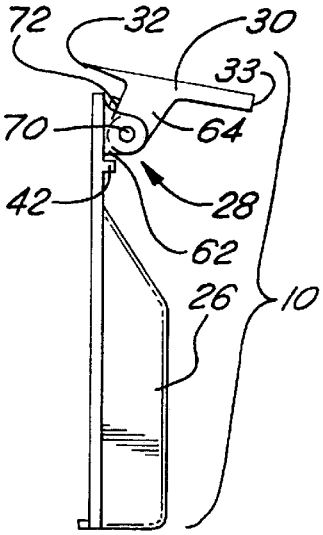
FIG. 11A is a side view of a third embodiment of a paint trimming apparatus.
Figure 11B:
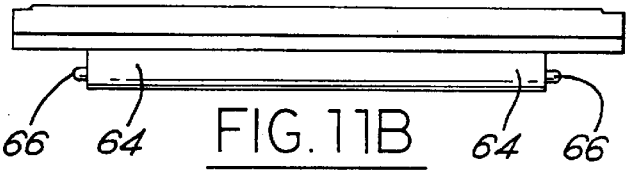
FIG. 11B is a top view of a guide having a portion of a guide support coupled thereto from FIG. 11A.
Figure 11C:
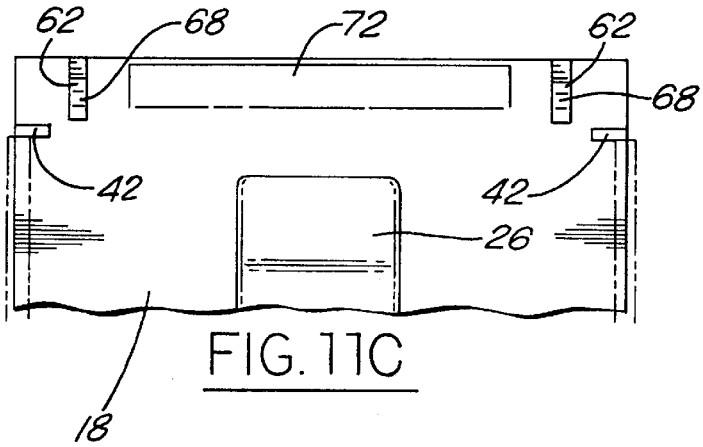
FIG. 11C is a top view having a second portion of guide support adapted to receive the first portion of guide support of FIG. 11B.

Referring now to FIGS. 11A, 11B and 11C, yet another embodiment of a paint trimming apparatus 10 is shown. In this configuration, support 28 is divided into two portions; a first portion 62 mounted to mounting plate 11 and a second portion 64 coupled to guide 30. One of either first portion or second portions preferably have nibs 66 to be received in holes 68. Nibs 66 and holes 68 define a pivot axis 70 about which guide 30 and thus guide edge 32 pivot. As illustrated, nibs 66 are formed in second portion 64 while holes 68 are formed in first portion 62. Although the opposite is possible. A spring 72 is used to provide a biasing force to prevent guide edge 32 from freely extending into the paint trimming position. Spring 72 as shown is mounted to mounting plate 11. Spring 72 consists of a piece of plastic extending from mounting plate 11 which contacts second portion 64. The spring force 72 is easily overcome by the finger of a painter when the paint trimming position is desired. As would be evident to those skilled in the art, spring 72 may take many forms. For example, spring 72 may be an integral piece mounted to either first portion 62 or second portion 64. Spring 72 may also be a piece of formed wire or the like coupled to mounting plate 11.

Figure 12A:
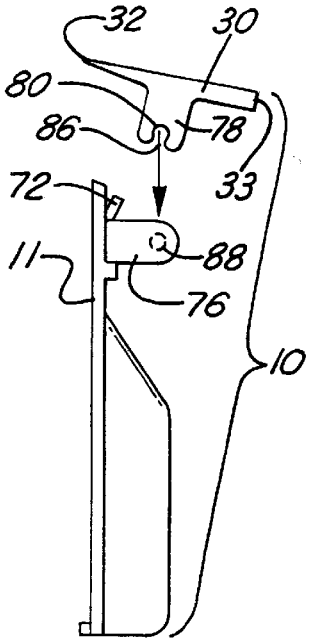
FIG. 12A is a side view of a fourth embodiment of a paint trimming apparatus.
Figure 12B:
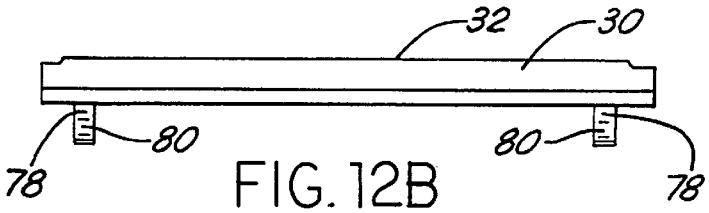
FIG. 12B is a top view of a guide having a second portion of a guide support mounted thereto.
Figure 12C:
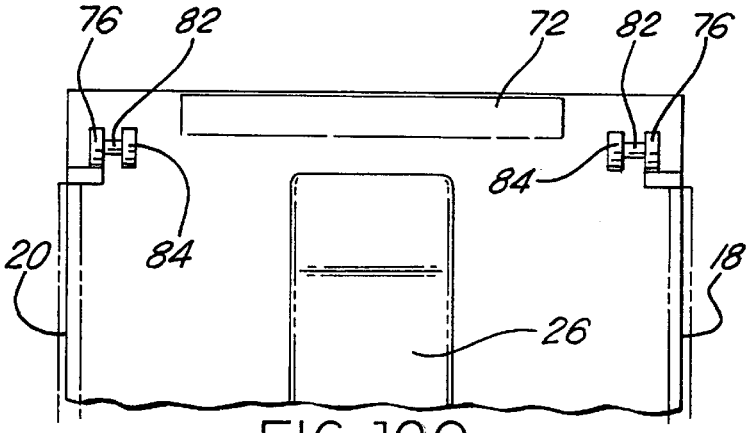
FIG. 12C is a top view of a mounting plate having a first portion of a guide support for receiving the second portion of guide support of FIG. 12B.

Referring now to FIGS. 12A, 12B and 12C yet another alternative embodiment of a paint trimming apparatus 10 is shown. Similar to that shown in FIG. 11, support 28 is formed of a first portion 76 mounted to mounting plate 11 and a second portion 78 mounted to guide 30. Second portion 78 has a guide hole 80 which is a hole partially enclosed its circumference. First portion 76 has an axle 82 and a stop 84. Second portion 78 and guide 30 are preferably integrally formed. First portion 76, axle 82 and stop 84 are preferably integrally formed with mounting plate 11. Guide hole 80 is sized to be received on axle 82. Guide hole 80 has an opening 86 slightly smaller than that of the diameter of axle 82 so that opening 86 flexes slightly outward as second portion is brought into contact with first portion 76. A spring 72 may be used to bias guide edge 32 to a neutral position. Spring 72 may be of the type described with respect to FIG. 11.

Figure 13A:
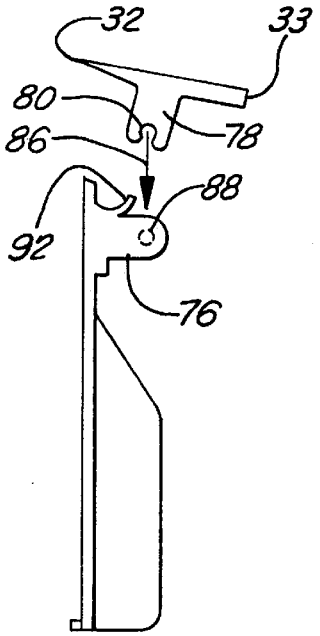
FIG. 13A is a side view of a fifth embodiment of a paint trimming apparatus.
Figure 13B:
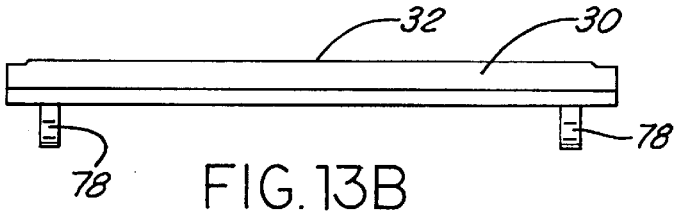
FIG. 13B is a top view of a guide and a portion of guide support.
Figure 13C:
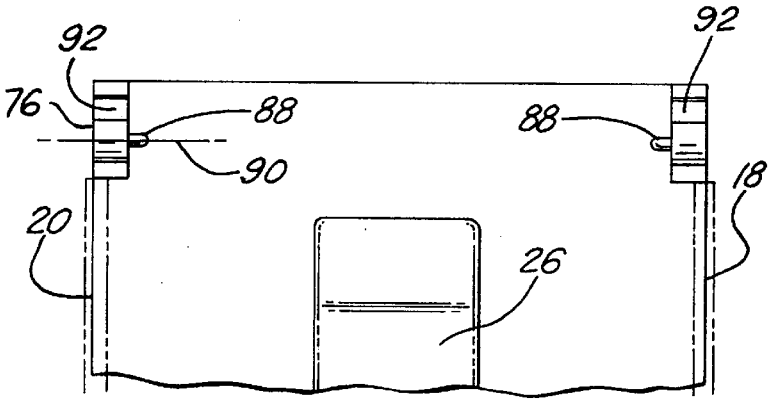
FIG. 13C is a top view of a mounting plate having a portion of a guide support adapted to receive the guide and portion of guide support of FIG. 13B.

Referring now to FIGS. 13A, 13B and 13C, second portion 78 having a guide hole 80 and opening 86 are formed in a similar manner to that of FIG. 12. First portion 76 is slightly altered. First portion 76 has nibs 88. Nibs 88 align with guide hole 80 to form a pivot axis about which guide and guide edge 32 rotate. Opening 86 is flexible so that it is received over nibs 88 and snapped into position. Once guide hole 80 is located around nibs 88, guide 30 pivots freely.

A spring 92 is coupled to first portion 76. Spring 92 is preferably integrally molded with first portion 76. However, spring 92 may be a separate component. Spring 92 provides a biasing force against second portion 78 to prevent the free movement of guide 30 about pivot axis 90. In operation, paint trimming apparatus 10 must be first assembled if the configuration shown in FIGS. 10, 11, 12 and 13 are used. That is, guide 30 must be coupled to mounting plate 11. Typically, pad 34 will be provided as a separate component capable of replacement. Pad 34 is slid in a forward direction from rear edge 16 until mounting edges 40 contact stops 42. Guide 30 will be in a neutral position. Guide 30 is thus easily positioned so that guide edge 32 contacts the intersection between the paintable surface 50 and adjacent surface 52. Upon release of a downward force, guide edge 32 retreats from the intersection of the paintable surface 50 and adjustable surface 52. Paint may then be applied to pad 34 while the painter places guide 30 in a loading position. It should be understood by those skilled in the art that the loading position may also be neutral position.

It should be understood by those skilled in the art that variations and modifications to the preferred embodiments described above may be made without departing from the true scope of the invention as defined by the following claims:

I claim:

1. A paint trimming apparatus having a paint loading position and a paint trimming position comprising:

a mounting plate of generally uniform thickness having a longitudinal axis, a top surface, a bottom surface, a front edge, a rear edge, and a pair of parallel side edges;

a handle having a front end and a back end mounted on the top surface of said mounting plate and extending along said longitudinal axis forwardly from said rear edge towards and spaced from said front edge;

a generally elongated planar guide, with upper and lower end portions, having a guide edge substantially parallel to the front edge of the lower end portion thereof, said guide edge having a length generally corresponding to the length of said front edge; and a guide support coupled to said mounting plate between the front end of said handle and the front edge of said mounting plate, said guide support pivotally coupling said guide to said mounting plate to position said guide edge to overlie the front edge and position the guide between the loading and paint trimming positions, said guide support yieldably biasing said guide to the loading position.

2. A paint trimming apparatus as recited in claim 1, further comprising a paint absorbent pad having front and rear end surfaces, said pad being of generally rectangular configuration and removably secured to the bottom surface of said mounting plate.

3. The paint trimming apparatus recited in claim 2, wherein said pad is removably secured to the bottom surface of said mounting plate by an adhesive.

4. A paint trimming apparatus as recited in claim 2, wherein said pad has a length greater than the length of said mounting plate so that the front end surface of said pad extends forwardly beyond the front edge of said mounting plate.

5. A paint trimming apparatus as recited in claim 2, wherein said guide edge has a pointed edge which overlies the front end surface of said pad when the apparatus is in a paint trimming position.

6. The paint trimming apparatus recited in claim 5, wherein the lower end portion of said guide has a pair of intersecting surfaces forming the pointed edge, with the included angle between the surfaces of said guide edge blade being in the range of 7° to 12°.

7. The paint trimming apparatus recited in claim 6, wherein said angle is approximately 9°.

8. A paint trimming apparatus as recited in claim 6, wherein said upper end portion of said guide forms a lever by which a person may depress the lever and thereby flex said guide support thereby raising the guide edge of the lower end portion away from the front end surface of said pad when in a paint loading position thereby preventing paint from being applied to said guide; the release of the force applied to the lever of said upper end portion permitting the guide support to return said painted edge to a position adjacent to the front end surface of said pad.

9. The paint trimming apparatus recited in claim 1, wherein said handle is integrally formed with said mounting plate and said guide support.

10. The paint trimming apparatus recited in claim 1, wherein said mounting plate, handle and guide support are made from a clear or colored plastic material.

11. The paint trimming apparatus recited in claim 1, further comprising a mounting portion having tabs coupled to said guide support, said mounting portion, said guide support and said guide forming an attachable unit, said paint trimming apparatus further comprising a receiver coupled to said mounting plate, said mounting portion sized to be received within said receiver.

12. The paint trimming apparatus recited in claim 1, wherein said guide support comprises a first portion mounted to said mounting plate and a second portion mounted to said guide, said first portion pivotally mounted to said second portion.

13. The paint trimming apparatus recited in claim 12, wherein said first portion has a hole therein, said second portion has a nib sized to be received within said hole.

14. The paint trimming apparatus recited in claim 13, wherein said mounting plate has a spring coupled thereto, said spring biasing said second portion away from a paint trimming position.

15. The paint trimming apparatus recited in claim 12, wherein said first portion has an axle and a stop coupled thereto, said second portion has an opening sized to receive the axle.

16. The paint trimming apparatus recited in claim 15, wherein said mounting plate has a spring coupled thereto, said spring biasing said second portion away from a paint trimming position.

17. The paint trimming apparatus recited in claim 12, wherein said first portion has a nib coupled thereto, said second portion has an opening sized to receive the nib.

18. The paint trimming apparatus recited in claim 17, wherein said first portion has a spring coupled thereto, said spring biasing said second portion away from a paint trimming position.

19. A paint trimming apparatus having a paint loading position and a paint trimming position comprising:

a mounting plate of generally uniform thickness having a longitudinal axis, a top surface, a bottom surface, a front edge, a rear edge, and a pair of parallel side edges;

a handle having a front end and a back end mounted on the top surface of said mounting plate and extending along said longitudinal axis forwardly from said rear edge towards and spaced from said front edge;

a generally elongated planar guide, with upper and lower end portions, having a guide edge substantially parallel to the front edge at the lower end portion thereof, said guide edge having a length generally corresponding to the length of said front edge; and a guide support coupled to said mounting plate between the front end of said handle and the front edge of said mounting plate, said guide support pivotally coupling said guide to said mounting plate to position said guide edge to overlie the front edge and position the guide between the loading and paint trimming positions, said guide support yieldably biasing said guide to the loading position; and a paint absorbent pad having front and rear end surfaces, said pad being of generally rectangular configuration and secured to the bottom surface of said mounting plate;

said pad having a length greater than the length of said mounting plate so that the front end surface of said pad extends forwardly beyond the front edge of said mounting plate;

the lower end portion of said guide edge having a pointed edge which overlies the front end surface of said pad when the apparatus is in a paint trimming position;

the upper end portion of said guide edge forming a lever by which a person may depress the lever and thereby flex said guide support thereby raising the pointed edge of the lower end portion away from the front end surface of said pad when in a paint loading position thereby preventing paint from being applied to said guide;

the release of the force applied to said lever permitting the guide support to return said painted edge to a position adjacent to the front end surface of said pad.

20. A paint trimming apparatus as recited in claim 19, wherein said pad has a length greater than the length of said mounting plate so that the front end surface of said pad extends forwardly beyond the front edge of said mounting plate.

21. The paint trimming apparatus recited in claim 19, wherein the lower end portion of said guide has a pair of intersecting surfaces forming the pointed edge, with the included angle between the surfaces of said guide edge blade being in the range of 7° to 12°.

22. The paint trimming apparatus recited in claim 21, wherein said angle is approximately 9°.

23. The paint trimming apparatus recited in claim 19, wherein said mounting plate, said handle and guide support are made from a clear or colored plastic material.

24. The paint trimming apparatus recited in claim 19, further comprising a mounting portion having tabs coupled to said guide support, said mounting portion, said guide support and said guide forming an attachable unit, said paint trimming apparatus further comprising a receiver coupled to said mounting plate, said mounting portion sized to be received within said receiver.

25. The paint trimming apparatus recited in claim 19, wherein said guide support comprises a first portion mounted to said mounting plate and a second portion mounted to said guide, said first portion pivotally mounted to said second portion.

26. The paint trimming apparatus recited in claim 25, wherein said first portion has a hole therein, said second portion having a nib sized to be received within said hole.

27. The paint trimming apparatus recited in claim 25, wherein said mounting plate has a spring coupled thereto, said spring biasing said second portion away from a paint trimming position.

28. The paint trimming apparatus recited in claim 25, wherein said first portion has an axle and a stop coupled thereto, said second portion has an opening sized to receive the axle.

29. The paint trimming apparatus recited in claim 25, wherein said first portion having a nib coupled thereto, said second portion having an opening sized to receive the nib.

30. The paint trimming apparatus recited in claim 25, wherein said first portion having a spring coupled thereto, said spring biasing said second member away from a paint trimming position.

* * * * *